US005806492A

United States Patent [19]

Collingborn

[11] Patent Number: 5,806,492

[45] Date of Patent: Sep. 15, 1998

[54] FUEL PUMP

[75] Inventor: Peter A. G. Collingborn, Gillingham, England

[73] Assignee: Lucas Industries, England

[21] Appl. No.: 800,791

[22] Filed: Feb. 14, 1997

[30] Foreign Application Priority Data

Mar. 23, 1996 [GB] United Kingdom ..... 9606493

[51] Int. Cl.[6] ..... F02M 41/00

[52] U.S. Cl. ..... 123/450

[58] Field of Search ..... 123/450; 417/273

[56] References Cited

U.S. PATENT DOCUMENTS

| | | | |
|---|---|---|---|
| 4,526,154 | 7/1985 | DiDomenico | 123/450 |
| 4,889,096 | 12/1989 | Brunel | 123/450 |
| 5,081,906 | 1/1992 | Lemaire et al. | 417/273 |
| 5,090,295 | 2/1992 | Cunningham et al. | 417/273 |
| 5,425,341 | 6/1995 | Connolly et al. | 123/450 |
| 5,619,971 | 4/1997 | Kubo et al. | 123/450 |

*Primary Examiner*—Thomas N. Moulis

[57] ABSTRACT

A fuel pump comprises a distributor member having a plunger reciprocable within a bore. A shoe and roller arrangement is associated with the plunger, the roller of which cooperates with a cam surface to move the plunger under the influence of the cam surface. Drive means is provided for driving the shoe and roller arrangement, the drive means including a member having a bore of circular cross-section, the shoe of the shoe and roller arrangement being reciprocable within the bore of the drive means.

18 Claims, 2 Drawing Sheets

FIG 1
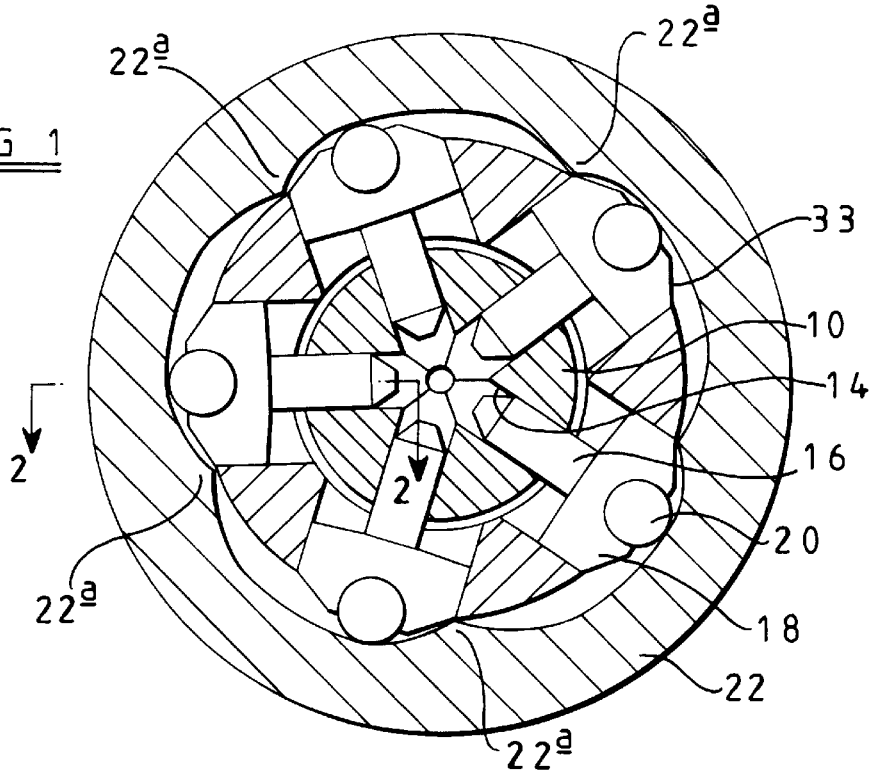
FIG 2
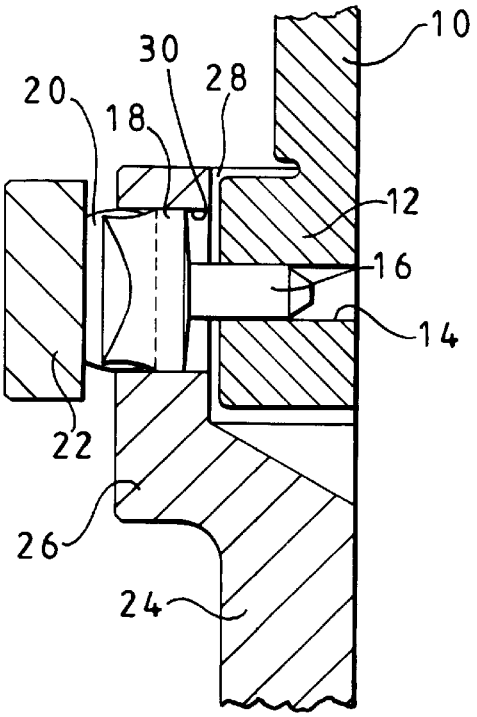
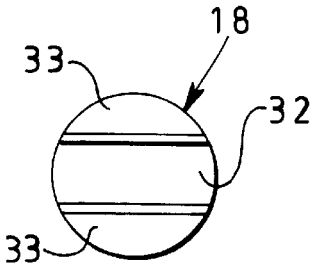
FIG 3
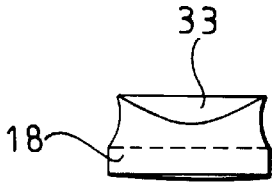
FIG 4
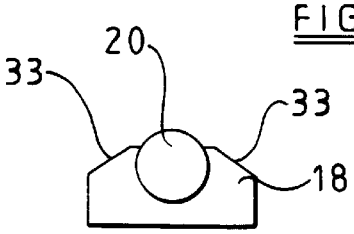
FIG 5

FUEL PUMP

This invention relates to a fuel pump intended for use in supplying fuel at high pressure to the cylinders of an internal combustion engine.

A rotary fuel pump comprises a distributor member which is rotatable within a sleeve. The distributor member includes a region of enlarged diameter in which a plurality of radially extending bores is provided. The bores communicate with passages provided in the distributor member and sleeve to permit relatively low pressure fuel to be supplied to the bores, and to permit fuel from the bores to be supplied to the cylinders of an associated engine.

A pumping plunger is reciprocable within each of the bores, the outer end of each plunger carrying a shoe and roller arrangement the roller of which is arranged to engage the cam surface of a cam ring so that as the roller rides over a cam lobe of the cam surface, the plunger associated therewith is pushed inwardly to compress and deliver fuel to a cylinder of the engine.

In order to reduce the loading on the distributor member, it is known to provide a drive arrangement for the shoe and roller arrangements, the drive arrangement including a drive member extending coaxially with the distributor member and driven at the same speed as the distributor member. An end of the drive member is hollow, the enlarged region of the distributor member being received therein. The end face of the hollow part of the drive member is provided with radially extending slots aligned with the bores of the distributor member and of, for example, rectangular cross-section, the shoe and roller arrangements being located within the slots. The slots and shoes are of dimensions such that radial movement of the shoes is substantially unrestricted, circumferential movement within the slots being restricted such that rotary movement of the drive member causes the shoe and roller arrangements to rotate at the same rotary speed as the distributor member thus maintaining the alignment of the shoes with the associated plunger members.

The provision of slots in the end face of the drive member is difficult where the drive member is to be used with a pump having five plungers as the slots cannot extend across the full diameter of the drive member. Further, the material between the slots where five slots are provided is subject to severe bending stresses, the provision of additional vents in the drive member further weakening the drive member.

According to the present invention there is provided a fuel pump comprising a distributor member having a plunger reciprocable within a bore, a shoe and roller arrangement associated with the plunger, the roller of the shoe and roller arrangement being engageable with the cam surface of a cam ring such that the plunger is reciprocable under the influence of the cam surface, and drive means for driving the shoe and roller arrangement, wherein the drive means includes a member having a bore of circular cross-section provided therein, the shoe of the shoe and roller arrangement being reciprocable within the bore of the drive member.

The provision of a circular cross-section bore extending part way across the diameter of the drive member is easier to achieve than the provision of the slot across part of the diameter of the drive member, thus the invention is particularly applicable to pumps having five plungers.

The invention also relates to a shoe and roller arrangement and drive means suitable for use in a fuel pump of the type described hereinbefore.

The invention will further be described, by way of example, with reference to the accompanying drawings, in which:

FIG. 1 is a cross-sectional view of a fuel pump according to a first embodiment of the invention;

FIG. 2 is a cross-sectional view along the line 2—2 of FIG. 1;

FIGS. 3, 4 and 5 are plan, side and end views of the shoe, FIG. 5 also showing the roller, of the shoe and roller arrangements used in the embodiment of FIGS. 1 and 2;

Figure 6:
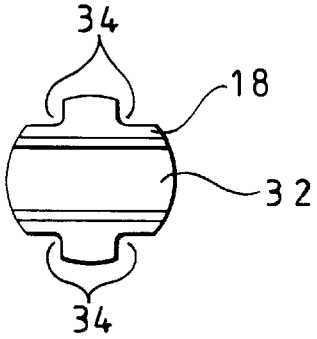
FIGS. 6, 7 and 8 are views similar to FIGS. 3, 4 and 5 of an alternative shoe.

The fuel pump illustrated in FIGS. 1 and 2 is intended for use in supplying fuel to the cylinders of a five cylinder internal combustion engine. The fuel pump comprises a distributor member 10 which is rotatable within a sleeve (not shown) the distributor member including a region 12 of enlarged diameter within which five equi-angularly spaced radially extending bores 14 are provided. A plunger 16 is reciprocable within each of the bores 14.

The outer end of each plunger 16 engages the shoe 18 of an associated shoe and roller arrangement, the roller 20 of which is arranged to engage the inner, cam surface of a cam ring 22. The cam surface includes five equi-angularly spaced cam lobes 22*a*. In use, on rotation of the distributor member with respect to the cam ring 22, when the rollers 20 ride over the cam lobes 22*a*, the rollers 20 and hence the plungers 16 are pushed inwardly thus compressing and pumping fuel from the bores 14.

A drive member 24 extends co-axially with the distributor member 10, the drive member 24 being arranged to be driven at the same speed as and in the same direction as the distributor member 10. As illustrated in FIG. 2, the drive member 24 includes an enlarged diameter region 26 within which a bore 28 is provided, the diameter of the bore 28 being sufficiently large to enable the enlarged diameter region 12 of the distributor member 10 to be received therein. The enlarged diameter region 26 of the drive member 24 is provided with five equi-angularly spaced, and axially aligned, bores 30 within which respective ones of the shoes 18 of the shoe and roller arrangements are received. The bores 30 are positioned so as to be aligned with the bores 13 provided in the distributor member 10, such alignment being maintained in use as the drive member 24 and distributor member 10 are arranged to be driven in the same direction at the same speed.

The bores 30 are each of circular cross section, the shoes 18 received therein also being of circular cross-section as illustrated in FIG. 3. The shoes 18 are therefore of generally cylindrical form. FIGS. 1, 2, 4 and 5 all illustrate that one of the end surfaces of each substantially cylindrical shoe 18 is of part spherical form. The other end of each shoe 18 is provided with a recess 32 arranged to receive a roller 20 such that the axis of rotation of the roller 20 with respect to the shoe 18 is parallel to the ax is of rotation of the distributor member 10. In order to ensure that the shoes 18 do not contact the cam surface of the cam ring 22, the end of the shoe 18 within which the roller 20 is carried is cut away to define angled surfaces 33.

As illustrated in the drawings, the recess 32 provided in each shoe 18 within which the roller 20 is received is of part circular, re-entrant form, the axis of rotation of the roller 20 being received within the recess 32 thus the roller 20 is trapped within the shoe 18. Thus, if in use the roller 20 leaves the cam surface of the cam ring 22, the roller 20 is retained within the recess 32.

As the shoes 18 are housed within the bores 30, movement of the shoes 18 in the axial direction of the drive member 24 is restricted, thus the catch plate which is provided in conventional arrangements can be omitted.

Figure 7:
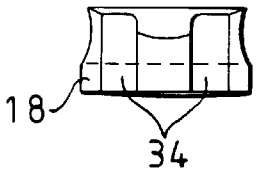
Figure 8:
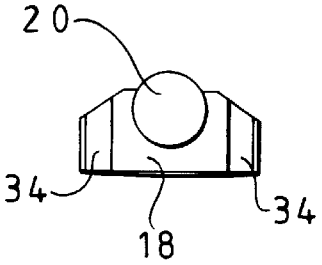

The shoes 18 illustrated in FIGS. 6, 7 and 8 differ from those illustrated in FIGS. 1 to 5 in that the shoes 18 are provided with venting slots 34 which permit fuel flow along the length of the shoe 18. The remainder of the shoe 18 is of circular cross-section conforming with the shape of the bores 30 provided in the enlarged part 26 of the drive member 24.

Figure 9:
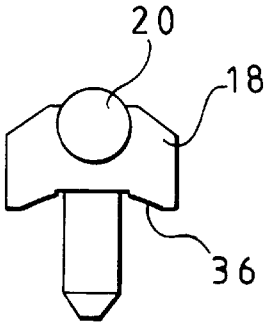
FIG. 9 is an end view of a further alternative shoe.

FIG. 9 shows a further alternative design of shoe 18. The cross-sectional shape of this design may either be circular as in FIGS. 1 to 5, or may be provided with the venting slots 34 as in FIGS. 6 to 8. As illustrated in FIG. 9, the shoe 18 is elongated so as to provide a greater length measured in the radial direction of the distributor member, and hence an enlarged area of contact between the shoe 18 and the enlarged diameter part 26 of the drive member 24 to provide improved guidance of the shoe 18 and to reduce the forces necessary for stabilizing the torque during pumping. The shaping of the shoe 18 includes a recess 36 which is arranged to ensure that the shoe 18 does not contact the enlarged part 12 of the distributor member 10. A central part of the recess 36 is shaped for engagement with the end of the associated plunger so that the load applied to the plunger is applied along the axis of the plunger.

Figure 10:
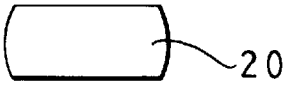
FIGS. 10, 11 and 12 are views of alternative roller designs.
Figure 11:
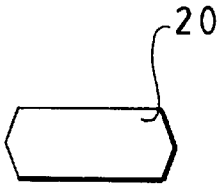
Figure 12:
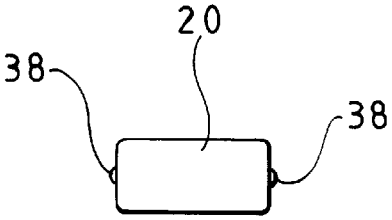

FIGS. 10, 11 and 12 show three different designs of roller 20 which may be used in the pump illustrated in FIG. 1. FIGS. 2 and 10 show a roller 20 having part spherical ends, the maximum axial length of the roller 20 illustrated in FIG. 10 being substantially equal to the diameter of the bore 30 thus engagement between the roller 20 and bore 30 ensures that the roller 20 is correctly positioned, in use. The roller design illustrated in FIG. 11 differs from that of FIG. 10 in that the ends of the roller are of conical form, and again the maximum axial length of the roller is substantially equal to the bore diameter to ensure that the roller is correctly positioned in use. The roller of FIG. 12 includes planar end walls the centres of which are provided with pips 38 which project from the plane of the end walls by a sufficient amount to ensure that only the pips 38 of the roller engage the walls defining the bore 30, the maximum axial length of the roller including the pips 38 being substantially equal to the diameter of the bore 30 in order to ensure correct positioning of the roller in use.

In use, the pumping loads applied to the rollers ensure that the rollers remain correctly aligned with respect to the cam surface. Should the rollers leave the cam surface, the angle of the shoes with respect to the drive member may change slightly, thus the rollers are no longer correctly aligned with respect to the cam surface. However, as the rollers engage the next cam lobes of the cam surface, the load applied to the rollers is sufficient to realign the rollers with the cam surface.

Although the pumping load maintains correct alignment of the rollers with respect to the cam surface, angular movement of the shoes may be limited using, for example, pins engaging with grooves provided in the shoes and/or drive member 24. Alternatively, a sleeve may be provided either externally or internally of the drive member, the sleeve having tongues associated therewith which extend alongside the shoes to limit angular movement of the shoes with respect to the drive member.

It is envisaged to use two sets of relatively small plungers spaced apart in the axial direction of the distributor member. Each plunger has a shoe and roller arrangement associated therewith, the shoes being of reduced diameter and received within correspondingly reduced diameter bores provided in the drive member, the shoes carrying rollers of correspondingly reduced length.

Although the fuel pump illustrated in the accompanying drawings is a five plunger fuel pump and is intended for use in conjunction with a five cylinder engine, it will be recognised that the invention may be applied to pumps having other than five plungers, and similarly may be used in conjunction with engines other than those having five cylinders.

What is claimed is:

1. A fuel pump comprising a distributor member having a plunger reciprocable within a bore, a shoe and roller arrangement associated with the plunger, the roller of the shoe and roller arrangement being engageable with the cam surface of a cam ring such that the plunger is reciprocable under the influence of the cam surface, and drive means for driving the shoe and roller arrangement, wherein the drive means includes a member having a bore of circular cross-section provided therein, the shoe of the shoe and roller arrangement being reciprocable within the bore of the drive member.

2. A fuel pump as claimed in claim 1, wherein the shoe of the shoe and roller arrangement is shaped so as to avoid engagement with the cam surface.

3. A fuel pump as claimed in claim 1, wherein the shoe of the shoe and roller arrangement is of generally cylindrical shape.

4. A fuel pump as claimed in claim 1, wherein the shoe of the shoe and roller arrangement includes a plurality of vent slots, each vent slot extending in a direction parallel to the axis of reciprocating movement of the shoe.

5. A fuel pump as claimed in claim 1, wherein the shoe of the shoe and roller arrangement includes a surface arranged to engage the plunger, wherein the said surface of the shoe is shaped to avoid engagement between the shoe and the distributor member.

6. A fuel pump as claimed in claim 1, wherein the roller of the shoe and roller arrangement is of cylindrical form.

7. A fuel pump as claimed in claim 6, wherein the roller includes end surfaces of part spherical form.

8. A fuel pump as claimed in claim 6, wherein the roller includes end surfaces of conical form.

9. A fuel pump as claimed in claim 6, wherein the end surfaces of the roller are substantially planar, the end surfaces being provided with axially located pips.

10. A fuel pump as claimed in claim 1, wherein the distributor member includes five bores, a plunger being reciprocable within each bore, the plungers each having an associated shoe and roller arrangement reciprocable within respective bores provided in the drive means.

11. A shoe for use in a fuel pump having a distributor member having a plunger reciprocable within a bore, the shoe being in a shoe and roller arrangement associated with the plunger, the roller of the shoe and roller arrangement being engageable with a cam surface of a cam ring such that the plunger is reciprocable under the influence of the cam surface, and drive mechanism including a drive member having a bore of circular cross-section provided therein, the shoe and roller arrangement being reciprocable within the bore of the drive member, comprising:

a generally circular cross-sectioned member having a longitudinal axis and first and second ends:

said first end including a recess to receive the roller, and said second end being connected to the plunger.

12. A shoe as in claim 11, wherein:

said first end further includes an angled surface on each side of said recess, each said surface being angled to avoid contact with the cam surface of the cam ring.

13. A shoe as in claim 11, wherein:

said shoe further comprises venting slots to permit the flow of fuel along said longitudinal axis.

14. A roller, for use in a fuel pump having a distributor member having a plunger reciprocable within a bore, the roller being in a shoe and roller arrangement associated with the plunger, the roller of the shoe and roller arrangement being engageable with the cam surface of a cam ring such that the plunger is reciprocable under the influence of the cam surface, and drive mechanism including a drive member having a bore of circular cross-section provided therein, the shoe and roller arrangement being reciprocable within the bore of the drive member, comprising:

a generally circular cross-sectioned member having opposed ends, said ends being spherical in shape, said member further having a length substantially equal to the bore of the drive member, said member being received in a recess in the shoe.

15. A roller as in claim 14, wherein:

said ends are conical in shape.

16. A roller as in claim 14, wherein:

said ends comprise planar end walls, said planar end walls having pips, said pips engaging the walls defining the bore of the drive member.

17. A drive mechanism, for use in a fuel pump having a distributor member having a plunger reciprocable within a bore, a shoe and roller arrangement associated with the plunger, the roller of the shoe and roller arrangement being engageable with a cam surface of a cam ring such that the plunger is reciprocable under the influence of the cam surface, comprising:

a member having a bore of circular cross-section provided therein, the shoe and roller arrangement being reciprocable within said bore.

18. A fuel pump comprising a distributor member having a plunger reciprocable within a bore, a shoe and roller arrangement associated with the plunger, the roller of the shoe and roller arrangement being engageable with the cam surface of a cam ring such that the plunger is reciprocable under the influence of the cam surface, and drive mechanism for driving the shoe and roller arrangement, wherein the drive mechanism includes a drive member having a bore of circular cross-section provided therein, the shoe of the shoe and roller arrangement being reciprocable within the bore of the drive member.

* * * * *